United States Patent [19]

Keizer

[11] Patent Number: 4,563,934

[45] Date of Patent: Jan. 14, 1986

[54] CAPO-TREMOLO-SLIDE ATTACHMENT FOR GUITARS

[76] Inventor: Jon Keizer, 271 B Pleasantview Ave., Piscataway, N.J. 08854

[21] Appl. No.: 659,427

[22] Filed: Oct. 10, 1984

[51] Int. Cl.[4] ..... G10D 3/04

[52] U.S. Cl. ..... 84/313; 84/318; 84/319

[58] Field of Search ..... 84/173, 267, 285–291, 84/298–299, 312–313, 315–319

[56] References Cited

U.S. PATENT DOCUMENTS 2,145,718 1/1939 Finney ..... 84/317

2,183,579 12/1939 Neal ..... 84/317

*Primary Examiner*—Lawrence R. Franklin

*Attorney, Agent, or Firm*—B. P. Fishburne, Jr.

[57] ABSTRACT

A variably spring-tensioned capo-tremolo-slide is mounted on a guitar string bridging carriage having support wheels on opposite sides of the strings which engage and follow tracks recessed below the top face of the guitar body and being parallel to the strings and fretboard. During use, the attachment serves the purposes of three existing devices and produces effects which are uniquely its own.

6 Claims, 5 Drawing Figures

CAPO-TREMOLO-SLIDE ATTACHMENT FOR GUITARS

BACKGROUND OF THE INVENTION

The present invention has for its objective the combining of three previously-known devices used by guitarists to obtain desirable effects while using the instrument. In combining the three devices into a unified guitar attachment, the functional capability of each previous separate device is retained, and additional unique effects are realized through use of the attachment forming the subject matter of this invention.

Furthermore, the guitar attachment according to this invention is much more convenient to use and has greater versatility of usage than known prior art devices. Its use and its location on the body of the guitar allows the maintaining of an unobstructed fretboard, so that the guitar player can fret notes and chords which he or she would be unable to fret when using conventional equipment.

In the prior art, a conventional capo is clamped to the neck of the guitar across the fretboard at the desired fret. This results in a change of key by shortening the effective lengths of the guitar strings. A conventional capo is cumbersome and cannot easily be relocated or removed during play. Another disadvantage of the conventional capo overcome by the present invention is that notes and chords cannot be fretted behind it. The capo-tremolo-slide forming the essence of this invention will shorten the strings and produce the key change at the body of the guitar instead of along its neck. This allows the player to change keys swiftly without interrupting play. The device in its totality is simpler and much more convenient to use than the three separate devices which it replaces.

A conventional tremelo device, in essence, is a bar held in the palm of the hand while strumming and picking guitar strings. The tremolo device wavers the pitch of the guitar. By pushing the capo-tremolo-slide down against the guitar strings, the player is able to obtain the same effect realized by the hand-held tremolo device.

A combined capo-tremolo effect never available to guitar players previously is obtained by pushing down on the spring tension slide and moving the slide forwardly or rearwardly along the strings.

A conventional slide, the third separate device replaced by the invention, is placed on the finger of the player and moved up and down the neck of the guitar. This device is limited by the fact that all notes that slide must be parallel to one another. By means of the present invention, the sliding action is carried out at the body of the guitar and not along its neck. This removes the slide from the finger of the player, and no longer limits him to sliding only these notes which are parallel.

Another effect unique to the invention is obtained by moving the slide to a forward position and picking the strings behind it.

Other features and advantages of the invention will become apparent to those skilled in the art during the course of the following description.

BRIEF DESCRIPTION OF THE DRAWING FIGURES

DETAILED DESCRIPTION

Figure 1:
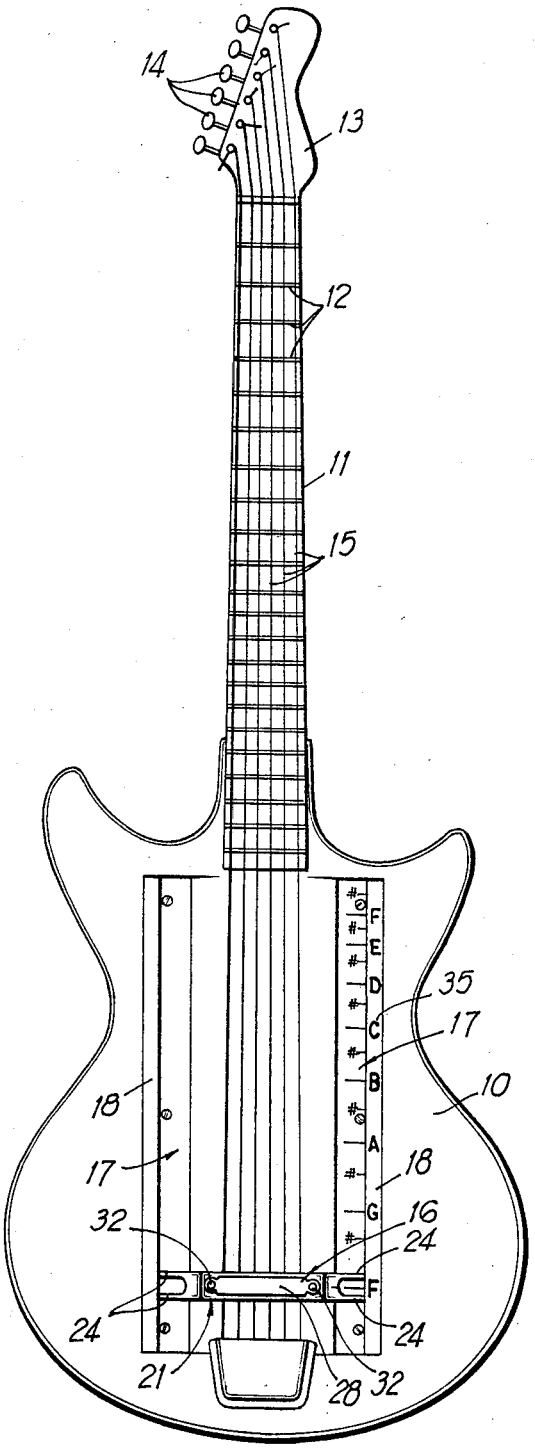
FIG. 1 is a plan view of a guitar equipped with a capo-tremelo-slide according to the present invention.
Figure 2:
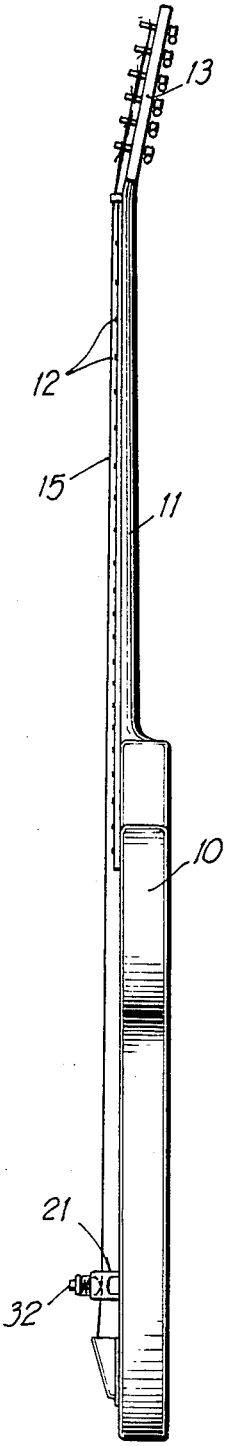
FIG. 2 is a side elevation of the guitar shown in FIG. 1.
Figure 3:
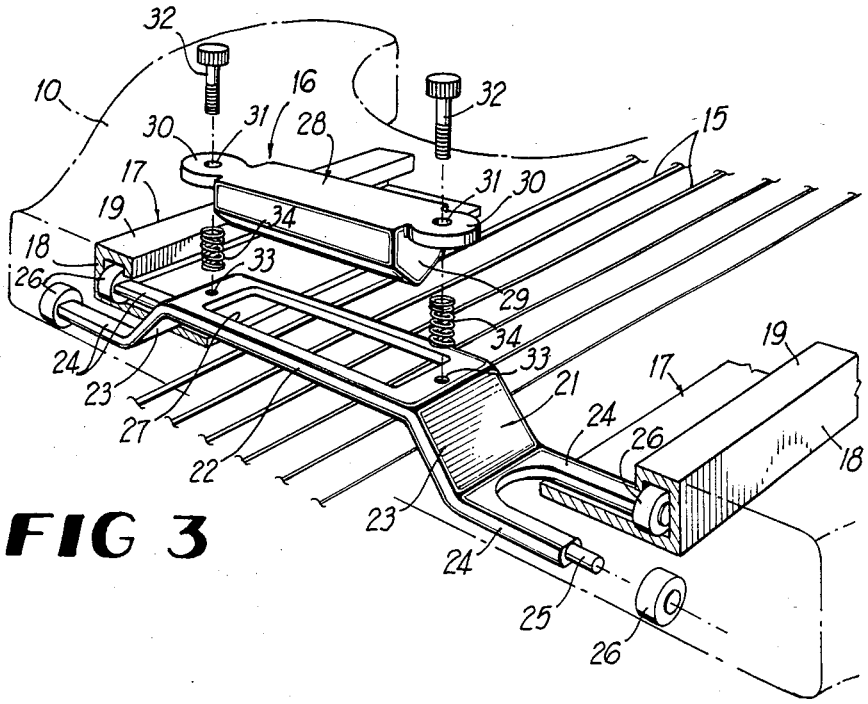
FIG. 3 is an exploded perspective view, partly in section, of the capo-tremolo-slide attachment.

Referring to the drawings in detail wherein like numerals designate like parts, a guitar shown in FIGS. 1 and 2 includes a sounding body 10 to which is attached a neck 11 having the usual frets 12 and terminating its rear end in a head 13 having adjusters 14 for the guitar strings 15.

Figure 4:
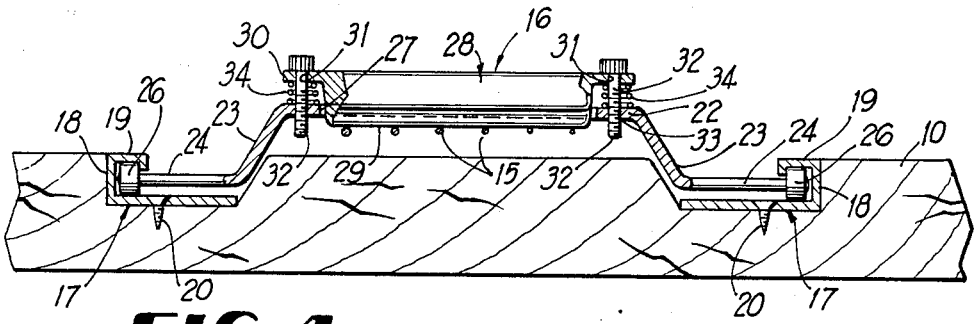
FIG. 4 is a transverse vertical section through the attachment in its assembled state.

A capo-tremolo-slide attachment 16 forming the main subject matter of the invention comprises a pair of spaced parallel guide tracks 17 which are recessed into the top wall of the sounding body 10, as best shown in FIG. 4. Each track 17 includes an outer side channel portion 18 having a top wall 19 which is preferably flush with the top face of the guitar sounding body 10. The channel portions 18 are open along their inner sides, as shown. The top walls 19 of channel portions 18 are above and parallel to the bottom plates of the tracks which may be anchored by screws 20 or by other suitable means. As best shown in FIG. 1, the guide tracks 17 extend longitudinally for most of the length of the sounding body 10 and are spaced equidistantly outwardly from opposite sides of the guitar strings in parallel relation thereto.

A string bridging carriage member 21 has an elevated center portion 22 spaced somewhat above and crossing the several strings 15. On opposite sides of the strings, the carriage member has inclined downwardly extending walls 23 which project somewhat into the recessed areas of the sounding body 10 and carry spaced parallel horizontal outwardly extending arms 24 terminating in small spindles 25 on which guide wheels 26 are freely rotatably mounted. These guide wheels, two on each side of carriage member 21, have precision guided engagement within the channel portions 18 of the two guide tracks 17.

The elevated portion 22 of carriage member 21 has a large rectangular opening 27 formed therethrough across and immediately above the strings 15. This opening receives movably therein a slide bar 28 having a downwardly tapering lower portion 29 adapted to contact the guitar strings 15 under certain operating conditions, yet to be described. At its opposite sides, the slide bar 28 carries apertured horizontal lugs 30 flush with the top face thereof which receive through the apertures 31 mounting and adjusting screws 32 for the slide bar 28.

The screws 32 are received in threaded openings 33 of the elevated portion 22 of carriage member 21. Adjustable tension springs 34 surround the screws 32 and exert an upward biasing force on the bottoms of the apertured lugs 30, the lower ends of the springs resting on the top of the elevated portion 22. The tension of the biasing springs 34 can be finely adjusted by turning the screws 32 which preferably have knurled heads. The arrangement serves to bias the slide bar 28 upwardly from the bridging carriage member 21 and allows the slide bar to be forced downwardly by the guitar player at any time into engagement with the strings 15 to produce the capo-tremolo-slide effects, previously discussed.

The entire assembly of the carriage member 21, slide bar 28, springs and adjusting screws is freely movable by the guitar player along the guide tracks 17 to establish the position of the slide bar 28 along the strings 15 desired at any given time.

The movement of the slide bar along the sounding body 10 can increase or decrease the effective sounding length of the strings 15, depending upon the direction of movement of the attachment, in turn effectively changing the key of the notes being sounded. Precise key changes can be indicated by a visible scale 35, FIG. 1, provided on the top face of the guide track nearest to the guitar player. The springs 34 allow the slide bar 28 to be depressed against the strings 15 to waver the pitch in a tremolo effect. Another effect heretofore unavailable to the player is obtained by moving the carriage member 21 and slide bar 28 and depressing the slide bar in a capo-tremolo effect.

By utilizing the adjusting screws 32, the slide bar 28 can be raised out of contact with the strings 15, thus allowing the player to make contact by depressing the slide bar 28 against the strings only at desired times. The versatility of operation of the device, its simplicity and convenience of use should be readily apparent to any knowledgeable guitar player.

Figure 5:
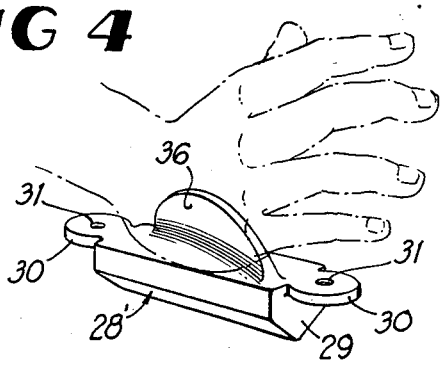
FIG. 5 is a perspective view of an alternate form of slide bar having a palm rest.

A modified form of the slide bar designated 28' is depicted in FIG. 5. In this form, the slide bar includes a contoured palm rest 36 rising from the top face of the bar. This arrangement may further facilitate using the invention by some players. This is an optional feature of the invention. In all other respects, the slide bars 28 and 28' are identical in construction and use.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A capo-tremolo-slide device for guitars comprising a pair of spaced parallel guide tracks adapted for attachment to a guitar sounding body on opposite sides of the guitar strings and extending longitudinally of the sounding body and strings for the major portion of the length of the sounding body in parallel relationship to the strings, said guide tracks including bottom walls, outer side walls and top walls and being open along their interior sides, an arched carriage including an elevated center portion disposed above said strings and across the strings and depressed end portions disposed near and above the bottom walls of said guide tracks, said end portions of the arched carriage being bifurcated to form a pair of spaced parallel arms on each end of the arched carriage at a common elevation, said arms being spaced apart longitudinally of the guide tracks and strings, wheels journaled on the arms and being guidingly engaged with said guide tracks, the elevated center portion of the arched carriage having a substantially rectangular opening formed therethrough and said opening being elongated across said strings and spanning the entire plane occupied by the strings, a slide bar disposed on said opening and adapted to move vertically therein, the bottom of the slide bar being adapted to engage the tops of said strings when the slide bar is depressed, a pair of adjusting screws engaged within threaded openings in the elevated center portion near the opposite ends of said opening, apertured lugs on the ends of the slide bar adjacent to its top face and the apertures of said lugs being engaged guidingly with said adjusting screws, and variable tension compression springs surrounding said adjusting screws between the bottoms of said apertured lugs and the top face of said elevated center portion.

2. A capo-tremolo-slide device for guitars as defined in claim 1, and said elevated center portion of the arched carriage being substantially flat, said slide bar having a flat top face and a body portion projecting downwardly through said substantially rectangular opening and having substantially a V-cross section at least near its bottom.

3. A capo-tremolo-slide device for guitars as defined in claim 2, and a contoured palm rest on said slide bar rising from its top face.

4. A capo-tremolo-slide device for guitars as defined in claim 1, and said guide tracks being recessed in the top of the guitar sounding body with the top walls of the track substantially flush with the top face of the sounding body and said depressed end portions of the arched carriage lying below the top face of the sounding body and being connected with the elevated center portion by upwardly convergent inclined walls.

5. A capo-tremolo-slide device for guitars comprising spaced parallel guide tracks mountable upon the top of a guitar sounding body to extend for the major portion of the length of said sounding body, an arched carriage bridging the strings of a guitar on which the device is installed and having a central elongated opening formed therethrough adjacent to and above the guitar strings, spaced arms carrying wheels on the opposite ends of said arched carriage and said wheels being engaged guidingly with said tracks, a slide bar floatingly held on the arched carriage within said opening and having a bottom surface element adapted to engage all of the guitar strings across their longitudinal axes, and variable tension resilient supporting and guidance means for the slide bar within said opening and being connected between the arched carriage and opposite end portions of the slide bar, whereby the slide bar can be depressed toward the guitar strings by a musician, the slide bar being resiliently biased away from said strings.

6. A capo-tremolo-slide device for guitars as defined in claim 5, and said variable tension resilient supporting and guidance means comprising a pair of adjusting screws connected between the arched carriage and said opposite end portions of the slide bars, and coiled compression springs surrounding said screws between the arched carriage and slide bar.

* * * * *